US011373608B2

(12) United States Patent
Lin

(10) Patent No.: US 11,373,608 B2
(45) Date of Patent: Jun. 28, 2022

(54) DISPLAY PANEL AND DISPLAY DEVICE

(71) Applicant: Shenzhen China Star Optoelectronics Semiconductor Display Technology Co., Ltd., Shenzhen (CN)

(72) Inventor: Yunglun Lin, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 289 days.

(21) Appl. No.: 16/627,302

(22) PCT Filed: Dec. 20, 2019

(86) PCT No.: PCT/CN2019/127064
§ 371 (c)(1),
(2) Date: Dec. 29, 2019

(87) PCT Pub. No.: WO2021/114379
PCT Pub. Date: Jun. 17, 2021

(65) Prior Publication Data

US 2021/0327372 A1 Oct. 21, 2021

(30) Foreign Application Priority Data

Dec. 11, 2019 (CN) ..... 201911268783.0

(51) Int. Cl.
*G09G 3/36* (2006.01)

(52) U.S. Cl.
CPC ... *G09G 3/3607* (2013.01); *G09G 2320/0233* (2013.01)

(58) Field of Classification Search
CPC ..... G09G 3/3607
See application file for complete search history.

(56) References Cited

U.S. PATENT DOCUMENTS

2005/0253797 A1* 11/2005 Kamada ..... G09G 3/3648 345/89
2008/0123003 A1* 5/2008 Onogi ..... G02F 1/133512 349/38
2011/0254759 A1* 10/2011 Mori ..... G09G 3/3648 345/88
2021/0011318 A1* 1/2021 He ..... G09G 3/3696

* cited by examiner

*Primary Examiner* — Kwang-Su Yang

(57) ABSTRACT

A display panel and a display device are provided, and the display panel includes a circuit layer and a pixel layer disposed over the circuit layer. The pixel layer includes a first region used to form a first sub-pixel and a second region used to form a second sub-pixel. The ability of light to pass through the liquid crystal molecules over the first and second subpixels sequentially decreases. The circuit layer includes a driving circuit disposed opposite to the first region, and a difference between image brightness above the first region and image brightness of above the second region is within a predetermined range.

20 Claims, 11 Drawing Sheets

DISPLAY PANEL AND DISPLAY DEVICE

RELATED APPLICATIONS

This application is a National Phase of PCT Patent Application No. PCT/PCT/CN2019/127064 having International filing date of Dec. 20, 2019, which claims the benefit of priority of Chinese Patent Application No. 201911268783.0 filed on Dec. 11, 2019. The contents of the above applications are all incorporated by reference as if fully set forth herein in their entirety.

FIELD AND BACKGROUND OF THE INVENTION

The present invention relates to the field of display technology, particularly to the manufacturing of display devices, and more particularly to an array display panel and a display device.

At present, in order to pursue a narrow frame of a display screen, a method of placing a gate driver on an array (GOA) in an active area (AA) can be adopted to reduce an area of a non-display area.

However, due to the extremely low light transmission of GOA, placing GOA in the AA will cause certain pixels to have lower aperture ratios than other pixels, resulting in lower uniformity of the screen brightness of the display panel.

Therefore, it is necessary to provide a display panel and a display device that can improve the uniformity of the screen brightness of the display panel.

SUMMARY OF THE INVENTION

An object of the present invention is to provide a display panel and a display device. Problems of low brightness uniformity of an image of the display panel is solved by disposing a first sub-pixel located above a driving circuit to meet small difference between an aperture ratio of the first sub-pixel and an aperture ratio of the second sub-pixel, which makes difference between the brightness of the picture above driving circuits and the brightness of the picture above other areas where no driving circuits are formed within a predetermined range.

An embodiment of the invention provides a display panel, composed of a display area and a non-display area, wherein the display panel comprises a circuit layer, a pixel layer disposed over the circuit layer, and a liquid crystal disposed over the pixel layer;

wherein the pixel layer comprises a plurality of first regions and a plurality of second regions, and the first regions are used to form a first sub-pixel, the second regions are used to form a second sub-pixel, and the second sub-pixel comprises a first pixel portion and a second pixel portion, and the first sub-pixel comprises a third pixel portion;

wherein the liquid crystal layer comprises a plurality of liquid crystal molecules, wherein an ability of light to pass through the plurality of liquid crystal molecules over the first pixel portion is greater than an ability of light to pass through the plurality of liquid crystal molecules over the second pixel portion, and an ability of light to pass through the plurality of liquid crystal molecules over the third pixel portion is greater than the ability of light to pass through the plurality of liquid crystal molecules over the first pixel portion when the display panel is operating; and wherein the circuit layer comprises a plurality of driving circuits, and the plurality of driving circuits are disposed in the display area, and the driving circuits are disposed opposite to the first regions, so that difference between a brightness of an image above the first regions and a brightness of an image above the second regions is within a predetermined range.

In one embodiment, the first sub-pixel further comprises a fourth pixel portion, and the third pixel portion and the fourth pixel portion are disposed adjacently.

In one embodiment, a projection of the driving circuits over the pixel layer overlaps or does not overlap with the first sub-pixel.

In one embodiment, the driving circuit is disposed at an arbitrary position directly below the third pixel portion, or a part of the driving circuit is disposed at an arbitrary position directly below the third pixel portion when the projection of the driving circuit over the pixel layer overlaps the first sub-pixel and the first sub-pixel comprises the third pixel portion.

In one embodiment, the driving circuit is disposed at any position directly below at least one of the third pixel portion and the fourth pixel portion, or a portion of the driving circuit is disposed at any position directly below at least one of the third pixel portion and the fourth pixel portion when the projection of the driving circuit over the pixel layer overlaps the first sub-pixel and the first sub-pixel comprises the third pixel portion and the fourth pixel portion.

In one embodiment, the driving circuits are disposed directly below any one side of the third pixel portion when the projection of the driving circuits over the pixel layer does not overlap with the first sub-pixel and the first sub-pixel comprises the third pixel.

In one embodiment, the driving circuits are disposed directly below a region between the third pixel portion and the fourth pixel portion, or the driving circuits are disposed below either side of at least one of the third pixel portion and the fourth pixel portion when the projection of the driving circuits over the pixel layer does not overlap with the first sub-pixel and the first sub-pixel comprises the third pixel and the fourth pixel portion.

In one embodiment, the driving circuits comprise a plurality of driving portions, and the plurality of driving portions are arranged in parallel and a distance between two adjacent driving portions is the same.

In one embodiment, the circuit layer further comprises a plurality of thin film transistor circuits, and the thin film transistor circuits are disposed opposite to the first regions and the second regions;

wherein the thin film transistor circuits are disposed directly below a region between the first pixel portion and the second pixel portion;

wherein the thin film transistor circuits are disposed directly below any one side of the third pixel portion when the first sub-pixel comprises the third pixel portion; and the thin film transistor circuits are disposed directly below a region between the third pixel portion and the fourth pixel portion, or the thin film transistor circuit is disposed directly under either side of at least one of the third pixel portion and the fourth pixel portion when the first sub-pixel comprises the third pixel portion and the fourth pixel portion.

An embodiment of the present invention provides a display panel, composed of a display area and a non-display area, wherein the display panel comprises a circuit layer, a pixel layer disposed over the circuit layer, and a liquid crystal disposed over the pixel layer;

wherein the pixel layer comprises a plurality of first regions and a plurality of second regions, and the first regions are used to form a first sub-pixel, the second regions are used to form a second sub-pixel, and the second sub-pixel comprises a first pixel portion and a second pixel portion, and the first sub-pixel comprises a third pixel portion;

wherein the liquid crystal layer comprises a plurality of liquid crystal molecules, wherein an ability of light to pass through the plurality of liquid crystal molecules over the first pixel portion is greater than an ability of light to pass through the plurality of liquid crystal molecules over the second pixel portion, and an ability of light to pass through the plurality of liquid crystal molecules over the third pixel portion is greater than the ability of light to pass through the plurality of liquid crystal molecules over the first pixel portion when the display panel is operating;

wherein the circuit layer comprises a plurality of driving circuits, and the plurality of driving circuits are disposed in the display area, and the driving circuits are disposed opposite to the first regions, so that difference between a brightness of an image above the first regions and a brightness of an image above the second regions is within a predetermined range; and wherein the projection of the driving circuit on the pixel layer overlaps or does not overlap with the first sub-pixel.

In one embodiment, the driving circuits are disposed at an arbitrary position directly below the third pixel portion, or a part of the driving circuits are disposed at a position directly below any position of the third pixel portion.

In one embodiment, the driving circuits are disposed directly below any one side of the third pixel portion when the first sub-pixel comprises the third pixel portion.

In one embodiment, the driving circuits comprise a plurality of driving portions, and the plurality of driving portions are arranged in parallel, and a distance between two adjacent driving portions is the same.

In one embodiment, the circuit layer further comprises a plurality of thin film transistor circuits, and the thin film transistor circuits are disposed opposite to the first region and the second region;

wherein the thin film transistor circuits are disposed directly below a region between the first pixel portion and the second pixel portion;

wherein the thin film transistor circuits are disposed directly below any one side of the third pixel portion when the first sub-pixel comprises the third pixel portion; and the thin film transistor circuits are disposed directly below a region between the third pixel portion and the fourth pixel portion, or the thin film transistor circuits are disposed directly under either side of at least one of the third pixel portion and the fourth pixel portion when the first sub-pixel comprises the third pixel portion and the fourth pixel portion.

An embodiment of the present invention further provides a display device, wherein the display device comprises a display panel composed of a display area and a non-display area, wherein the display panel comprises a circuit layer and a pixel layer provided over the circuit layer and a liquid crystal layer disposed over the pixel layer;

wherein the pixel layer comprises a plurality of first regions and a plurality of second regions, and the first regions are used to form a first sub-pixel, the second regions are used to form a second sub-pixel, and the second sub-pixel comprises a first pixel portion and a second pixel portion, and the first sub-pixel comprises a third pixel portion;

wherein the liquid crystal layer comprises a plurality of liquid crystal molecules, wherein an ability of light to pass through the plurality of liquid crystal molecules over the first pixel portion is greater than an ability of light to pass through the plurality of liquid crystal molecules over the second pixel portion, and an ability of light to pass through the plurality of liquid crystal molecules over the third pixel portion is greater than the ability of light to pass through the plurality of liquid crystal molecules over the first pixel portion when the display panel is operating; and wherein the circuit layer comprises a plurality of driving circuits, and the plurality of driving circuits are disposed in the display area, and the driving circuits are disposed opposite to the first regions, so that difference between a brightness of an image above the first regions and a brightness of an image above the second regions is within a predetermined range.

In one embodiment, the first sub-pixel further comprises a fourth pixel portion, and the third pixel portion and the fourth pixel portion are disposed adjacently.

In one embodiment, the projection of the driving circuit over the pixel layer overlaps or does not overlap the first sub-pixel.

In one embodiment, the driving circuits are disposed at an arbitrary position directly below the third pixel portion, or a part of the driving circuit is disposed at an arbitrary position directly below the third pixel portion when the projection of the driving circuits over the pixel layer overlaps the first sub-pixel and the first sub-pixel comprises the third pixel portion.

In one embodiment, the driving circuits are disposed at any position directly below at least one of the third pixel portion and the fourth pixel portion, or a portion of the driving circuits is disposed at any position directly below at least one of the third pixel portion and the fourth pixel portion when the projection of the driving circuit over the pixel layer overlaps the first sub-pixel and the first sub-pixel comprises the third pixel portion and the fourth pixel portion.

In one embodiment, the driving circuit is provided directly below any one side of the third pixel portion when the projection of the driving circuits on the pixel layer does not overlap the first sub-pixel and the first sub-pixel comprises the third pixel portion.

In one embodiment, the driving circuits are disposed directly below a region between the third pixel portion and the fourth pixel portion, or the driving circuits are disposed below either side of at least one of the third pixel portion and the fourth pixel portion when the projection of the driving circuit over the pixel layer does not overlap with the first sub-pixel and the first sub-pixel comprises the third pixel and the fourth pixel portion.

In one embodiment, the driving circuits comprise a plurality of driving portions, and the plurality of driving portions are arranged in parallel and a distance between two adjacent driving portions is the same.

The invention provides a display panel and a display device. The display panel is composed of a display area and a non-display area and comprises a circuit layer and a pixel layer provided over the circuit layer. The pixel layer comprises a plurality of first regions used to form a first sub-pixel, and a plurality of second regions used to form a second sub-pixel. The second sub-pixel comprises a first pixel portion and a second pixel portion, and the first sub-pixel comprises a third pixel portion. M1, M2, and M3 are respectively the ability of light to pass through liquid crystal molecules over the first pixel portion, the second pixel portion, and the third pixel portion, and M3≥M1>M2. The circuit layer comprises a plurality of driving circuits disposed in the display area, and the driving circuits are disposed opposite to the first area. In the present invention, problems of low brightness uniformity of an image of the display panel is solved by disposing a first sub-pixel located above a driving circuit to meet small difference between an aperture ratio of the first sub-pixel and an aperture ratio of the second sub-pixel, which makes difference between the brightness of the picture above driving circuits and the brightness of the picture above other areas where no driving circuits are formed within a predetermined range.

BRIEF DESCRIPTION OF THE SEVERAL VIEWS OF THE DRAWINGS

To detailly explain the technical schemes of the embodiments or existing techniques, drawings that are used to illustrate the embodiments or existing techniques are provided. Apparently, the illustrated embodiments are just a part of those of the present disclosure. It is easy for any person having ordinary skill in the art to obtain other drawings without labor for inventiveness.

DETAILED DESCRIPTION OF SPECIFIC EMBODIMENTS OF THE INVENTION

Figure 1:
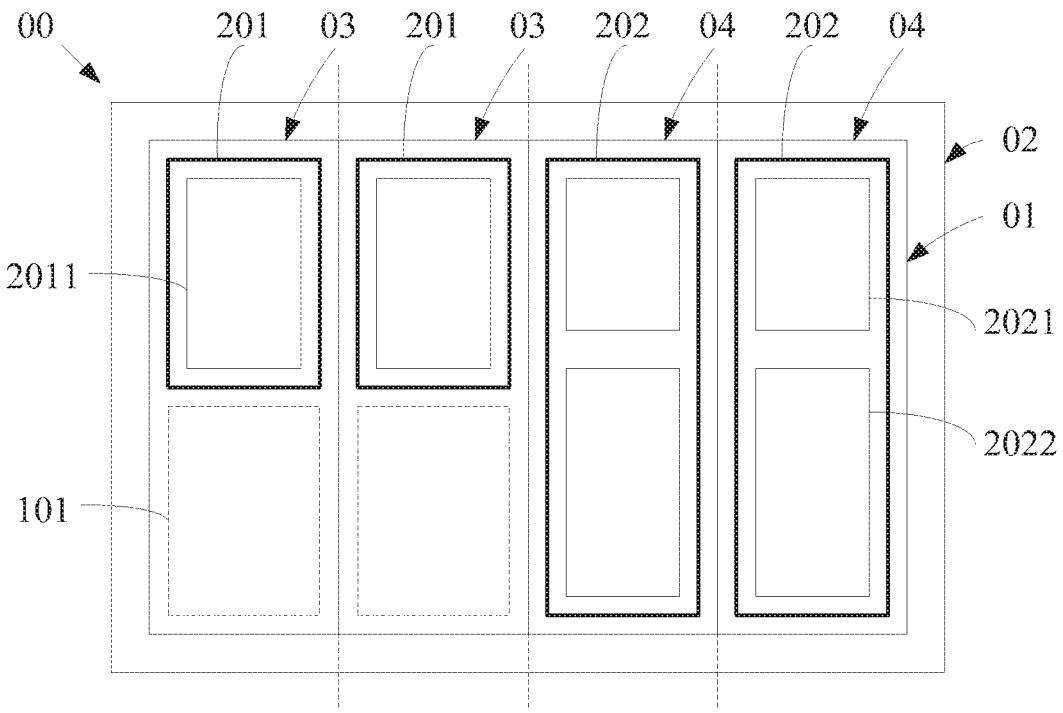
FIG. 1 is a schematic top view of a display panel according to one embodiment of the present invention.

In the following, the technical solutions in the embodiments of the present invention will be clearly and completely described with reference to the drawings in the embodiments of the present invention. Obviously, the described embodiments are only a part of the embodiments of the present invention, but not all the embodiments. Based on the embodiments of the present invention, all other embodiments obtained by those skilled in the art without creative work fall into the protection scope of the present invention.

In the description of the present invention, it should be understood that the orientations or positional relationships indicated by the terms "upper side" and "lower side" are based on the orientations or positional relationships shown in the drawings, where "upper side" is only a surface at above the object, it can refer to directly above, obliquely above, and the upper surface, as long as it lies above the level of the object in the drawing. "horizontal" and "longitudinal" also refer to all directions on the same horizontal plane based on the placement form of the drawing. "directly below" in this article indicates the vertical relationship in the vertical direction, and is not limited to the vertical projection position where one is located in the middle of the other, the above orientation or positional relationship. It is only for the convenience of describing the present invention and simplifying the description and does not indicate or imply that the device or element referred to must have a specific orientation, be constructed and operate in a specific orientation, and therefore cannot be understood as a limitation on the present invention.

It should be noted that the term "predetermined range" is a range predetermined in advance, and this predetermined range can be deduced according to a better result.

In addition, it should be noted that the drawings only provide structures and steps that are closely related to the present invention, and some details that have little to do with the invention are omitted. The purpose is to simplify the drawings and make the invention clearer than clear in practice, the device and/or method is exactly the same as the drawings and is not a limitation of the device and method in practice.

The present invention provides a display panel comprising, but not limited to, the embodiments shown in FIG. 1-21.

Figure 2:
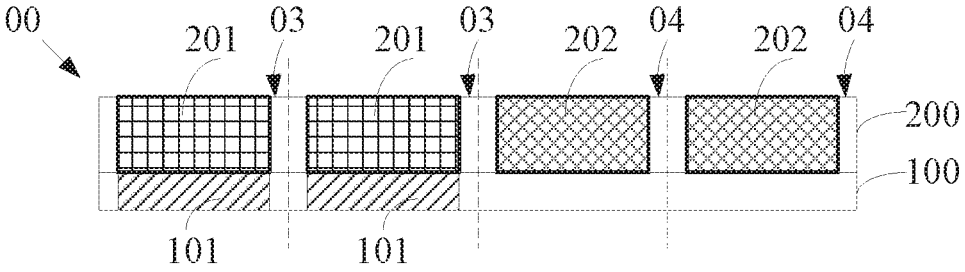
FIG. 2 is a schematic cross-sectional view of a display panel according to one embodiment of the present invention.

In one embodiment, as shown in FIG. 1-2, the display panel 00 is composed of a display area 01 and a non-display area 02, and the non-display area 02 may be disposed around the display area 01. The display panel 00 comprises a circuit layer 100 and a pixel layer 200 disposed over the circuit layer 100. Specifically, the pixel layer 200 includes a plurality of first regions 03 and a plurality of second regions 04. The first regions 03 are used to form a first sub-pixel 201, and the second regions 04 are used to form a second sub-pixel 201. The second sub-pixel 202 comprises a first pixel portion 2021 and a second pixel portion 2022, the first sub-pixel 201 comprises a third pixel portion 2011, and the circuit layer 100 comprises a plurality of driving circuits 101. The plurality of driving circuits 101 are disposed in the display area 01, and the driving circuits 101 are disposed opposite to the first regions 03. It can be understood that considering the consistency of the sub-pixels, sizes of the first sub-pixel 201 and the second sub-pixel 202 should be the same.

It can be understood that the display panel 00 further comprises a liquid crystal layer, and the liquid crystal layer is disposed above the pixel layer 200. The liquid crystal layer comprises a plurality of liquid crystal molecules. Particularly, when the display panel 00 is in operation, an ability of light to pass through liquid crystal molecules over the first pixel portion 2021 is greater than an ability of light to pass through liquid crystal molecules over the second pixel portion 2022, and an ability of light to pass the liquid crystal molecules over the third pixel portion 2011 is greater than or equal to the ability of light to pass through the liquid crystal molecules over the first pixel portion 2021. Furthermore, difference between an image brightness above the third regions 03 and an image brightness above the second regions 02 can be within a predetermined range by setting an area ratio of the third pixel portion 2011 in the first region 03, and an area ratio of the first pixel portion 2021 and the second pixel portion 2022 in the second area 02. Furthermore, the "predetermined range" should be a smaller value, which indicates that image brightness above the first region 03 and image brightness above the second region 02 tends to be uniform.

Among them, "the ability of light to pass through the liquid crystal molecules over the third pixel portion 2011 is greater than or equal to the ability of the light to pass through the liquid crystal molecules over the first pixel portion 2021" may be realized through making a voltage finally transmitted to the third pixel portion 2011 greater than or equal to an voltage finally transmitted to the first pixel portion 2021.

It can be understood that light is emitted from a backlight of the display panel 00, and light sequentially passes through the circuit layer 100, the pixel layer 200, the liquid crystal layer, the film layer above the liquid crystal layer, and an outermost packaging film layer of the display panel 00 to finally present a sub-corresponding picture above the first region 03 and the second region 02. Therefore, "difference between the image brightness above the first region 03 and the image brightness above the second region 02 is within a predetermined range" should be understood as the image brightness above a certain region is proportional to an amount of the light finally penetrates the outermost package film layer corresponding to the certain region.

In one embodiment, the first region 03 and the second region 04 in the pixel layer 200 may be disposed separately, or the first region 03 may be continuously disposed first, and then the second region 04 may be disposed continuously. It can be understood that the arrangement of the driving circuit 101 should be compatible with the division of the first region 03 and the second region 04 to ensure that the corresponding region of the driving circuit 101 in the pixel layer 200 is disposed with the first sub-pixel 201.

Figure 3:
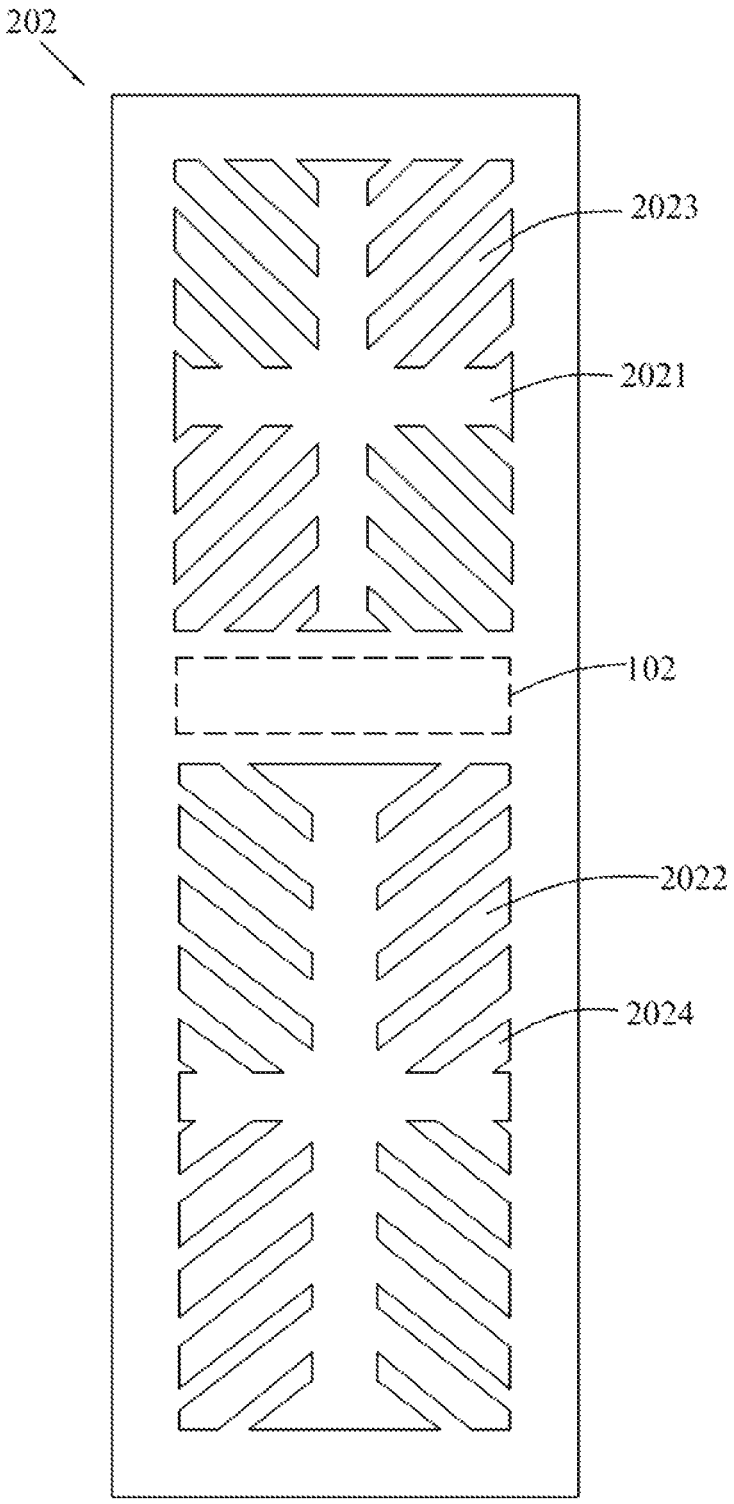
FIG. 3 is a schematic top view of an arrangement of a second sub-pixel and a thin film transistor circuit according to one embodiment of the present invention.

In one embodiment, as shown in FIG. 3, in the same second sub-pixel 202, the first pixel portion 2021 and the second pixel portion 2022 may be disposed adjacent to each other, such as up and down, left and right, and arranged adjacent to each other in a certain direction, etc. Here, the first pixel portion 2021 and the second pixel portion 2022 are arranged up and down as an example. Specifically, the first pixel portion 2021 and the second pixel portion 2022 may be four-domain pixels, and the four-domain pixels are arranged in a field-like shape, and each domain in the first pixel portion 2021 comprises a plurality of first pixel electrodes 2023 arranged in parallel with each other. Each domain in the second pixel section 2022 comprises a plurality of second pixel electrodes 2024 arranged in parallel with each other. The plurality of the first pixel electrodes 2023 in the first pixel portion 2021 and the plurality of the second pixel electrodes 2024 in the second pixel portion 2022 are arranged in a double cross shape. It is understandable that this arrangement can increase the viewing angle of the screen. Furthermore, the circuit layer 100 further comprises a plurality of thin film transistor circuits 102, which are disposed directly below a region between the first pixel portion 2021 and the second pixel portion 2022.

Figure 4:
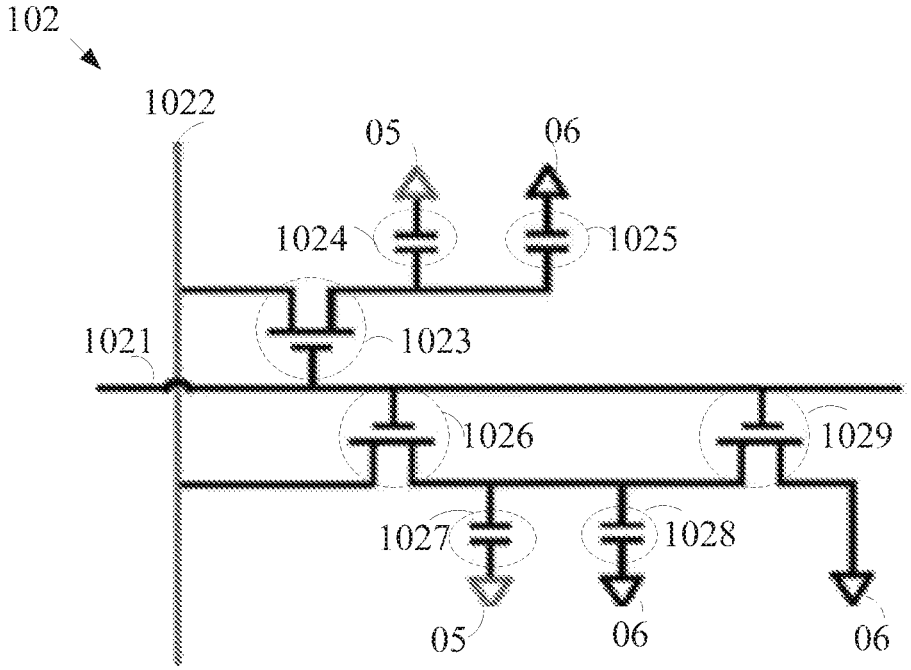
FIG. 4 is a schematic circuit diagram of a thin film transistor circuit according to one embodiment of the present invention.

In one embodiment, as shown in FIG. 4, the thin film transistor circuit 102 comprises a gate line 1021, a data line 1022, a first thin film transistor 1023, a first liquid crystal capacitor 1024, a first storage capacitor 1025, a second thin film transistor 1026, a second liquid crystal capacitor 1027, a second storage capacitor 1028, and a third thin film transistor 1029, wherein the gate line 1021 is electrically connected with a gate of the first thin film transistor 1023, a gate of the second thin film transistor 1063, and a gate of the third thin film transistor 1029. The data line 1022 is electrically connected with a source/drain of the first thin film transistor 1023 and a source/drain of the second thin film transistor 1063. One end of the first liquid crystal capacitor 1024 and one end of the first storage capacitor 1025 are both electrically connected to the drain/source of the first thin film transistor 1023. One end of the second liquid crystal capacitor 1027, one end of the second storage capacitor 1028, the source/drain of the third thin film transistor 1029 are electrically connected with the drain/source of the second thin film transistor 1026. The other end of the first liquid crystal capacitor 1024 and the other end of the second liquid crystal 1027 is electrically connected to the first common electrode 05. The other end of the first storage capacitor 1025, the other end of the second storage capacitor 1028, and the drain/source of the third thin film transistor 1029 are all electrically connected with the second common electrode 06. It should be noted that the electrical potentials of the first common electrode 05 and the second common electrode 06 are the same, and the first common electrode 05 may be disposed over the circuit layer 100. The projection of the first common electrode 05 over the pixel layer 200 may be in a region between two adjacent first sub-pixels 201, or between two adjacent second-pixels 202, or a region between two adjacent first and second sub-pixels 201 and 202. The second common electrode 06 may be disposed over a color filter substrate, and the color filter substrate is disposed over the pixel layer 200.

In addition, the first pixel portion 2021 is electrically connected with the drain/source of the first thin film transistor 1023, and the second pixel portion 2022 is electrically connected with the drain/source of the second thin film transistor 1026. It can be understood that when the display panel 00 is in operation, a discharge path is formed between the third thin film transistor 1029 and the second common electrode 06, resulting a voltage of the source/drain of the second thin film transistor 1026 is lower than a voltage of the source/drain of the first thin film transistor 1023, so the voltage of the first pixel portion 2021 is greater than the voltage of the second pixel portion 2022, such that the ability of light to pass through the liquid crystal molecules over the first pixel portion 2021 is greater than the ability of light to pass through the liquid crystal molecules over the second pixel portion 2022.

It can be understood that in addition to adopting the manner shown in FIG. 4, "the ability of light to pass through liquid crystal molecules over the first pixel portion 2021 is greater than the ability of said light to pass through liquid crystal molecules over the second pixel portion 2022", the third thin film transistor 1029 in FIG. 4 can also be removed, and the number of the data lines 1022 becomes two, wherein one of the data lines 1022 inputs an electric signal to the first thin film transistor 1023, and the other one of the data lines 1022 inputs an electrical signal to the second thin film transistor 1026, so that the voltage of the first pixel portion 2021 is greater than the voltage of the second pixel portion 2022. In general, the thin film transistor circuit 102 may comprise, but is not limited to, a three Thin-Film-Transistor (3 TFT) architecture, a charge sharing architecture, and a 2 Data and 1 Gate (2D1G) architecture.

In one embodiment, the projection of the driving circuit 101 over the pixel layer 200 overlaps or does not overlap with the first sub-pixel 201. Specific examples may include but are not limited to the following embodiments.

It should be noted that the effective light transmitting portion of the second sub-pixel 202 is the corresponding first pixel portion 2021 and the entire region of the corresponding second pixel portion 2022.

Figure 5:
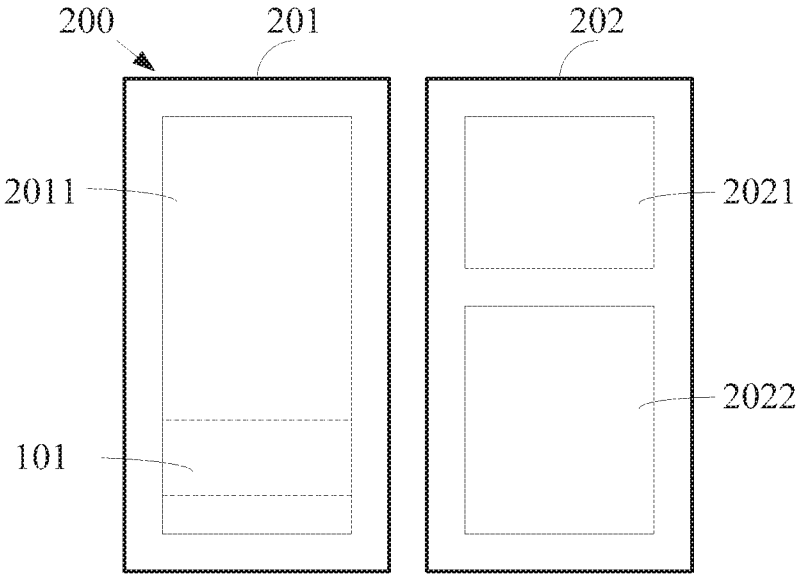
FIG. 5 is a schematic top view of an arrangement of a first pixel layer and a driving circuit provided by one embodiment of the present invention.
Figure 6:
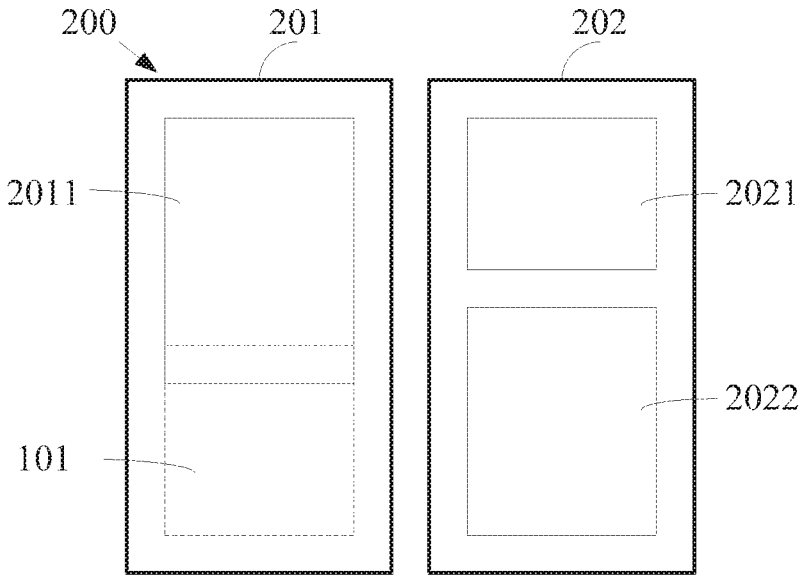
FIG. 6 is a schematic top view of an arrangement of a second pixel layer and a driving circuit provided by one embodiment of the present invention.
Figure 7:
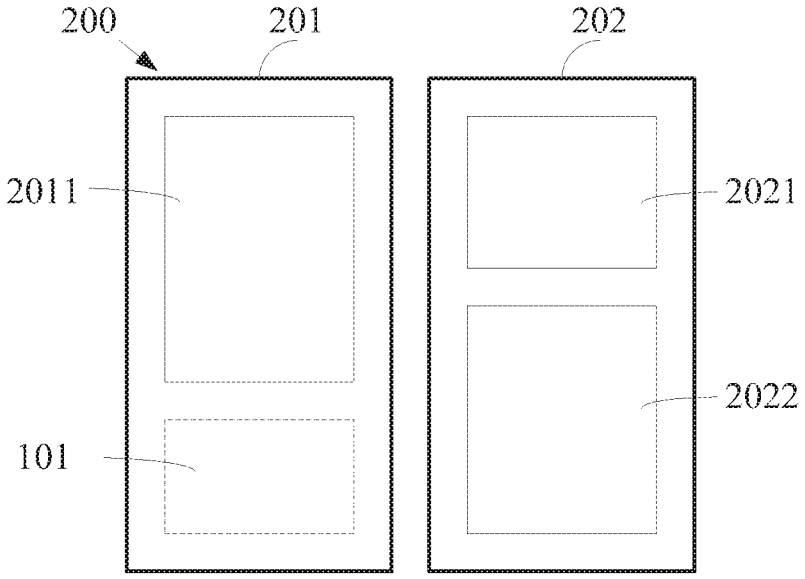
FIG. 7 is a schematic top view of an arrangement of a third pixel layer and a driving circuit provided by one embodiment of the present invention.

In one embodiment, when the first sub-pixel 201 comprises only the third pixel portion 2011, the ability of light to pass through the liquid crystal molecules over the third pixel portion 2011 equals the ability of the light to transmit through the liquid crystal molecules over the first pixel portion 2021. As shown in FIG. 5-7, the size of the third pixel portion 2011 in each of the first sub-pixels 201 is larger than that of each of the second pixels 2022. The size of the first pixel portion 2021 in the sub-pixel 202. Furthermore, as shown in FIG. 5, the driving circuit 101 may be disposed in the third pixel portion 2011 at any position directly below the third pixel portion 2011 when the projection of the driving circuit 101 over the pixel layer 200 overlaps with the first sub-pixel 201. For example, the driving circuit 101 may be disposed near the lower side directly below the third pixel portion 2011. Alternatively, as shown in FIG. 6, a part of the driving circuit 101 may be disposed at any position directly below the third pixel portion 2011. For example, a part of the driving circuit 101 near the upper side may intersect with the projection along a vertical direction of a portion of the third pixel portion 2011 near the lower side. It can be understood that, because the driving circuit 101 is opaque, the effective light transmitting portion of the first sub-pixel 201 is a region of the corresponding third pixel portion 2011 that does not intersect with the driving circuit 101. When the projection of the driving circuit 101 over the pixel layer 200 does not overlap with the first sub-pixel 201, that is, there is no intersection between the projection of the driving circuit 101 over the pixel layer 200 and the first sub-pixel 201 at all. As shown in FIG. 7, the driving circuit 101 may be disposed directly below any one side of the third pixel portion 2011. For example, the driving circuit 101 may be disposed directly below the third pixel portion 2011. Similarly, the effective light-transmitting portion of the first sub-pixel 201 is all regions in the corresponding third pixel portion 2011.

Figure 8:
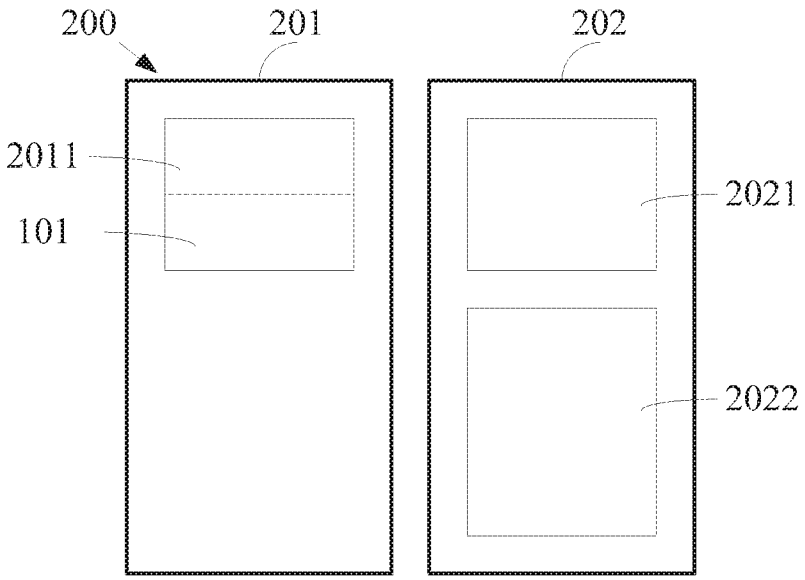
FIG. 8 is a schematic top view of an arrangement of a fourth pixel layer and a driving circuit provided by one embodiment of the present invention.
Figure 9:
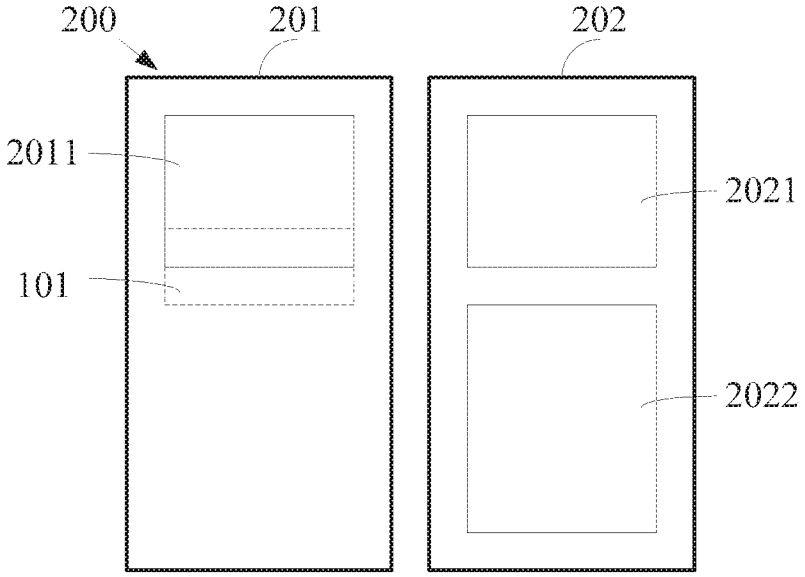
FIG. 9 is a schematic top view of an arrangement of a fifth pixel layer and a driving circuit provided by one embodiment of the present invention.
Figure 10:
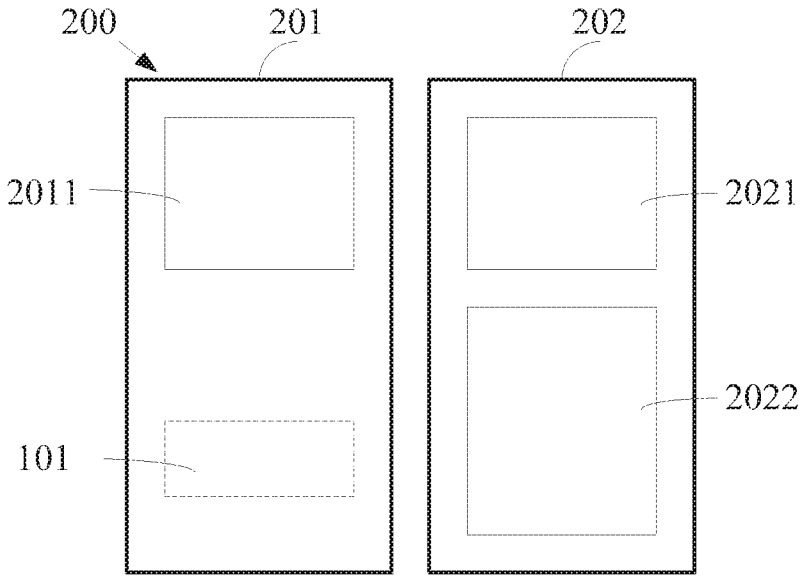
FIG. 10 is a schematic top view of an arrangement of a sixth pixel layer and a driving circuit provided by one embodiment of the present invention.
Figure 11:
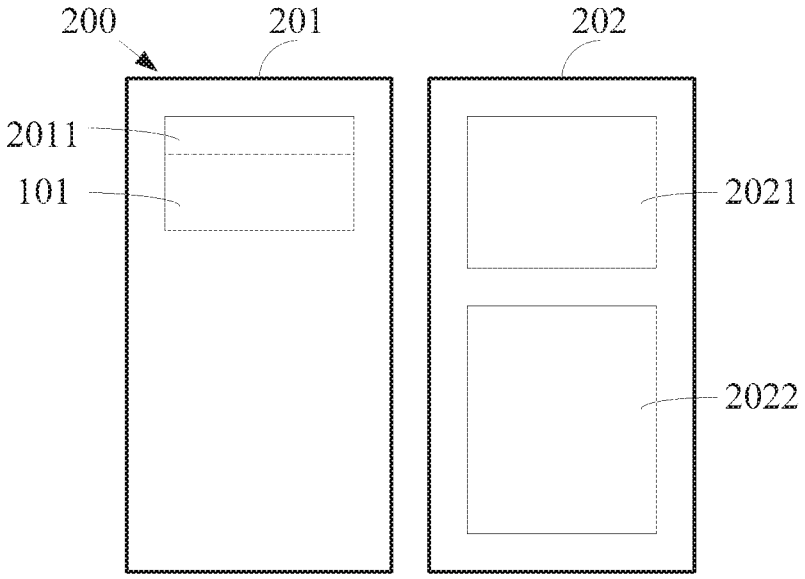
FIG. 11 is a schematic top view of an arrangement of a seventh pixel layer and a driving circuit provided by one embodiment of the present invention.
Figure 12:
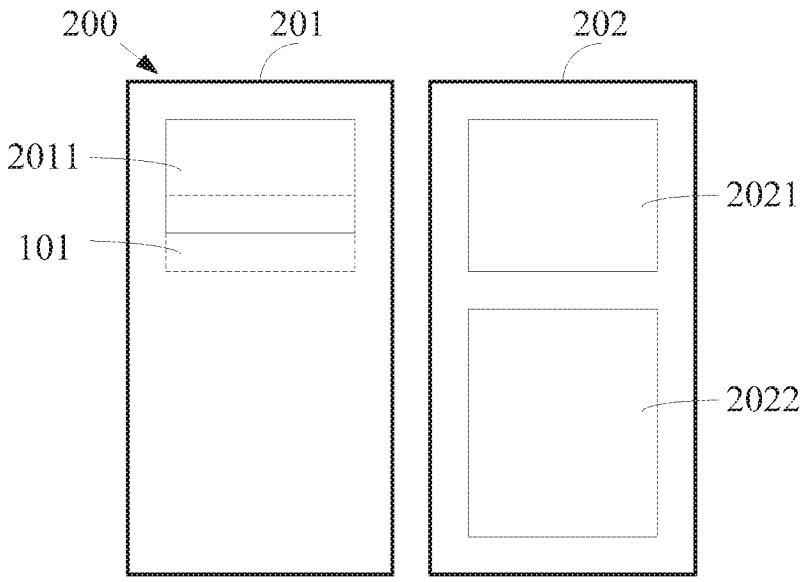
FIG. 12 is a schematic plan view of an arrangement of an eighth pixel layer and a driving circuit provided by one embodiment of the present invention.
Figure 13:
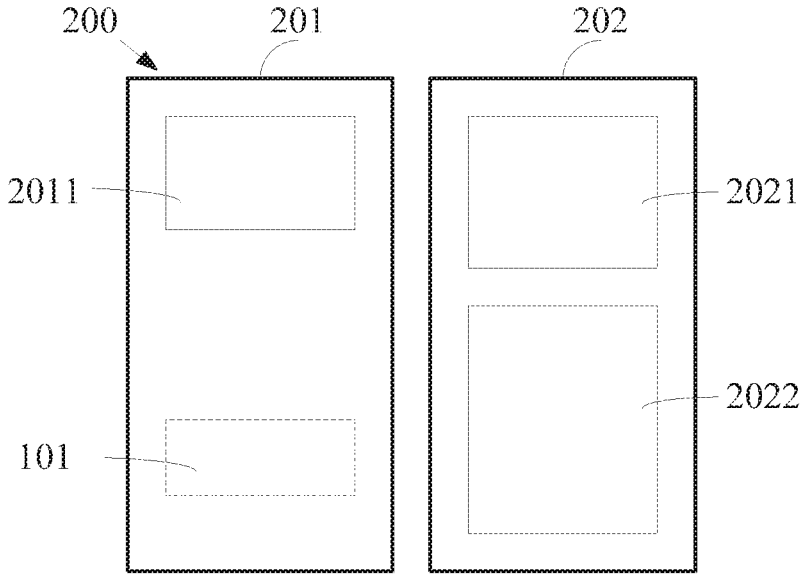
FIG. 13 is a schematic plan view of an arrangement of a ninth pixel layer and a driving circuit provided by one embodiment of the present invention.

In one embodiment, when the first sub-pixel 201 comprises only the third pixel portion 2011 and the ability of light to pass through the liquid crystal molecules on the third pixel portion 2011 is greater than the ability of light to pass through the liquid crystal molecules over the first pixel portion 2021, as shown in FIG. 5-7, the size of the third pixel portion 2011 in each of the first sub-pixels 201 is larger than the size of the third pixel portion 2011 in each of the second pixels 202, the related description may refer to the above. Alternatively, as shown in FIG. 8-10, the size of the third pixel portion 2011 in each of the first sub-pixel 201 is equal to the size of the first pixel portion 2021 in each of the second sub-pixels 202. Alternatively, as shown in FIG. 11-13, the third pixel portion 2011 in each of the first sub-pixels 201 is smaller than the size of the first pixel portion 2021 in each of the second sub-pixels 202.

It can be understood that the size of the third pixel portion 2011 in each of the first sub-pixels 201, the size of the first pixel portion 2021 in each of the second sub-pixels 202, and the size of the second pixel portion 2022, the ability of light to pass through liquid crystal molecules above the third pixel portion 2011 in each of the first sub-pixels 201, the ability of light to pass through the liquid crystal molecules above the first pixel portion 2021 in each of the second sub-pixels 202, and the ability of light to pass through the liquid crystal molecules above each of the second pixel portions 2022 should be comprehensively considered in order to achieve "the image brightness above the first region 03 and the image brightness of the second area 02 tends to be the same" as a benchmark.

Figure 14:
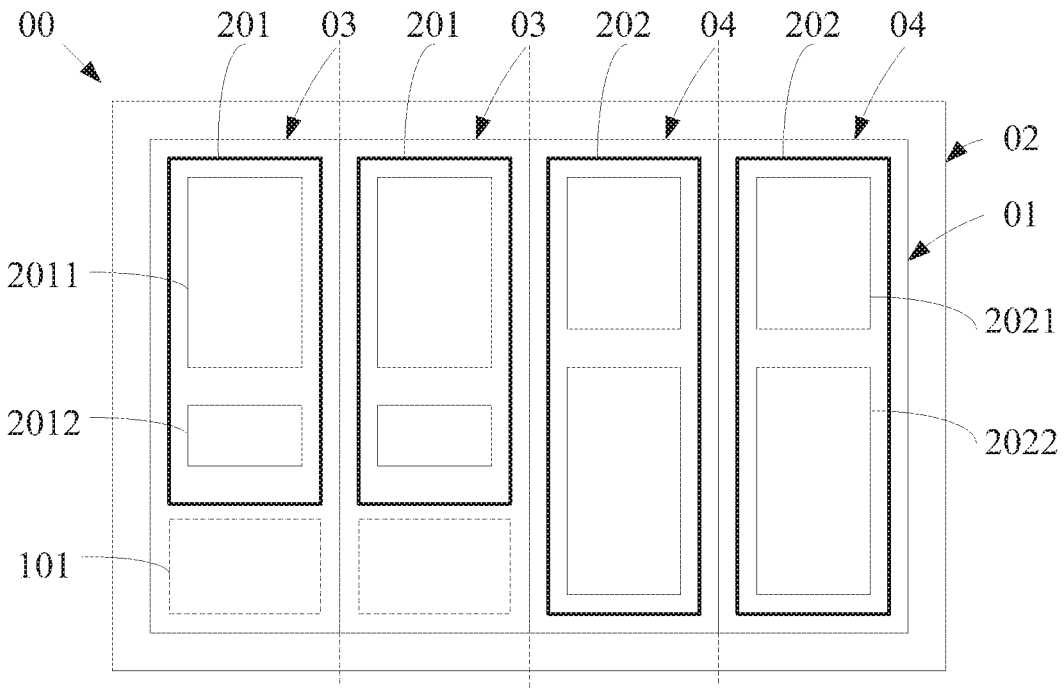
FIG. 14 is a schematic top view of another display panel according to one embodiment of the present invention.

In one embodiment, as shown in FIG. 14, the first sub-pixel 201 may further comprises a fourth pixel portion 2012, and the third pixel portion 2011 and the fourth pixel 2012 portion are disposed adjacently. The third pixel portion 2011 and the fourth pixel portion 2012 may be disposed adjacent to each other in a manner of, such as up and down, left and right, adjacently disposed along a certain direction, etc. Here, the third pixel portion 2011 and the fourth pixel portion 2012 are arranged up and down as an example. Further, specific internal structures of the third pixel portion 2011 and the fourth pixel portion 2012 may be referenced to the internal structures of the first pixel portion 2021 and the second pixel portion 2022 as shown in FIG. 3.

In one embodiment, when the first sub-pixel 201 comprises the third pixel portion 2011 and the fourth pixel portion2012 and if the ability of light to pass through liquid crystal molecules over the third pixel portion 2011 is equal to the ability of the light to pass through the liquid crystal molecules over the first pixel portion 2021, as shown in FIG. 15-18, it is feasible to make the size of the third pixel portion 2011 in each of the first sub-pixels 201 equal to or larger than the size of the first pixel portion 2021 in each of the second sub-pixels 202. Herein, the size of the third pixel portion 2011 in each of the first sub-pixels 201 is equal to the size of the first pixel portion 2021 in each of the second sub-pixels 202 is taken as an example.

Figure 15:
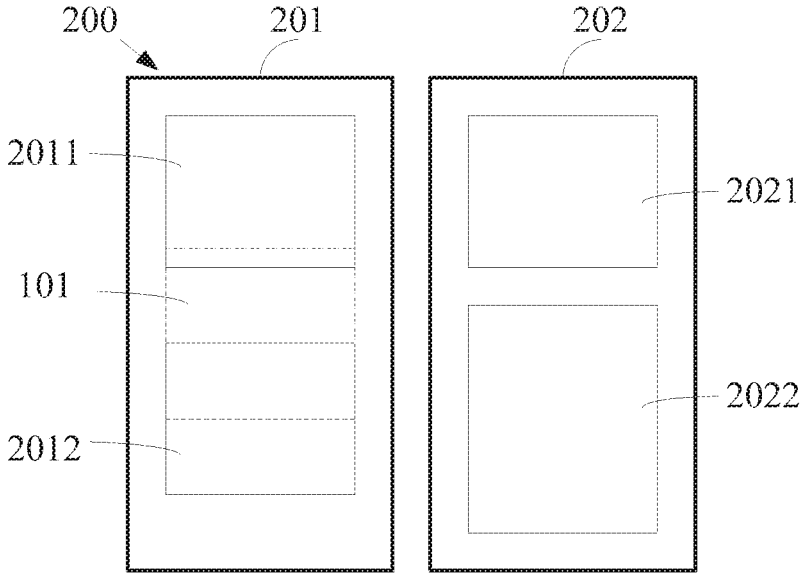
FIG. 15 is a schematic top view of an arrangement of a tenth pixel layer and a driving circuit provided by one embodiment of the present invention.
Figure 16:
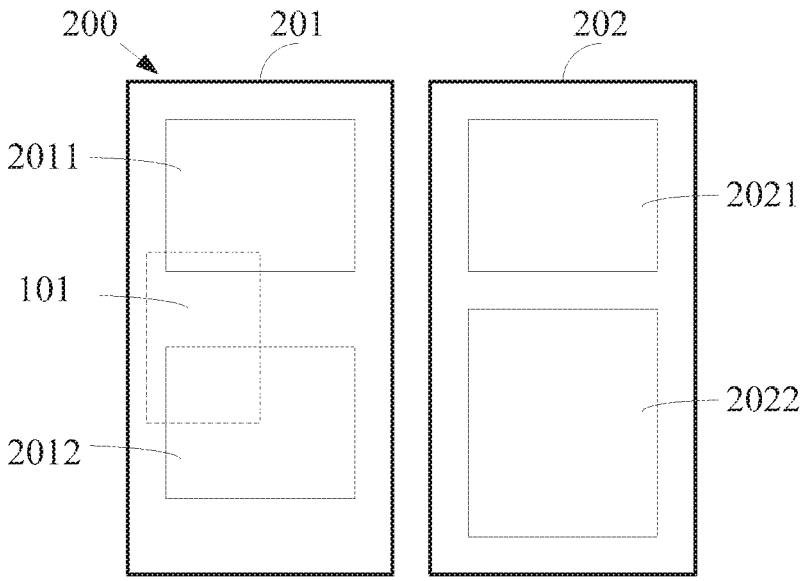
FIG. 16 is a schematic top view of an arrangement of an eleventh pixel layer and a driving circuit provided by one embodiment of the present invention.

Furthermore, when the projection of the driving circuit 101 over the pixel layer 200 overlaps the first sub-pixel 201, as shown in FIG. 15, the driving circuit 101 is disposed at an arbitrary position directly below at least one of the third pixel portion 2011 and the fourth pixel portion 2012. Here, an arbitrary position directly below the third pixel portion 2011 and the fourth pixel portion 2012 by the driving circuit 101 is taken as an example, the projection of the driving circuit 101 over the pixel layer 200 overlaps a part of the lower side of the third pixel portion 2011 and a part of the upper side of the fourth pixel portion 2012. Alternatively, as shown in FIG. 16, a part of the driving circuit 101 is disposed at an arbitrary position directly below at least one of the third pixel portion 2011 and the fourth pixel portion 2012. Herein, a portion of the driving circuit 101 disposed at any position directly below the third pixel portion 2011 and the fourth pixel portion 2012 is taken as an example, the projection of the driving circuit 101 over the pixel layer 200 overlaps a part of the lower left side of the third pixel portion 2011, a part of the upper right of the fourth pixel portion 2012, and some other areas in the first sub-pixel 201. It can be understood that, because the driving circuit 101 is opaque, the effective light transmitting portion of the first sub-pixel 201 is non-intersecting areas between the driving circuit 101 and the corresponding third pixel portion 2011 and the corresponding fourth pixel portion 2012.

Figure 17:
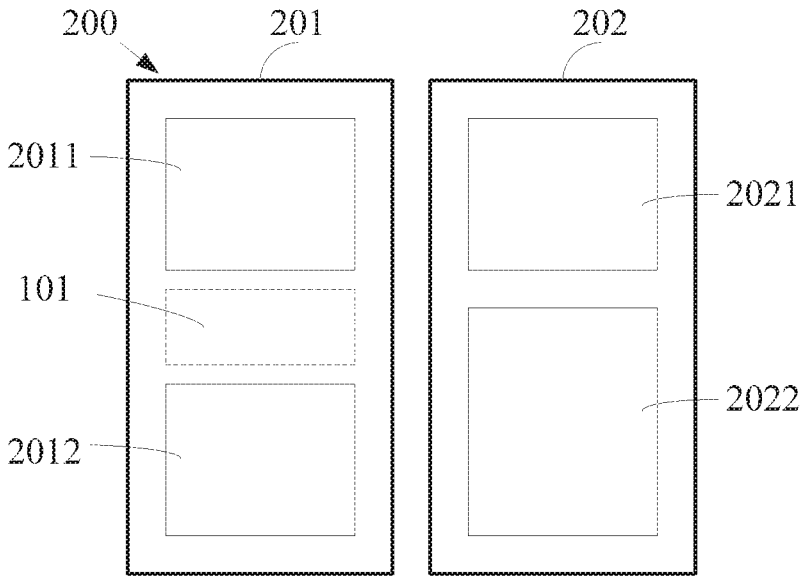
FIG. 17 is a schematic top view of an arrangement of a twelfth pixel layer and a driving circuit according to one embodiment of the present invention.
Figure 18:
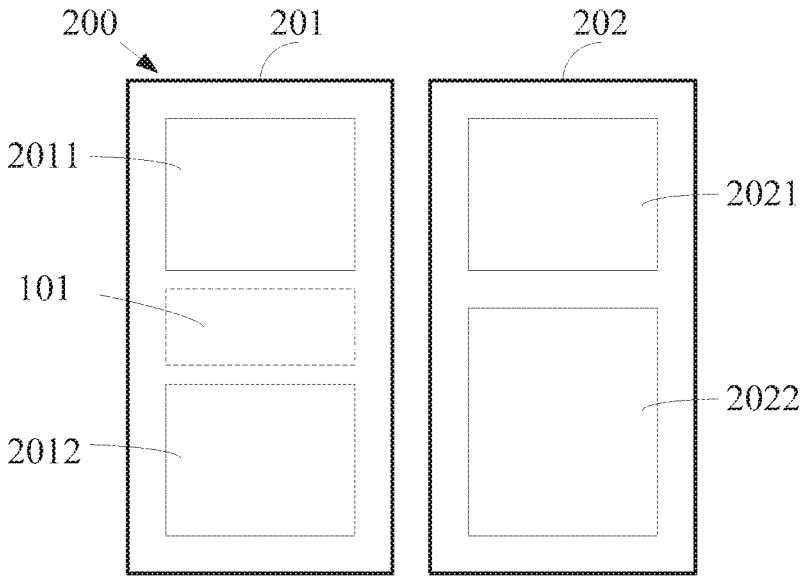
FIG. 18 is a schematic top view of an arrangement of a thirteenth pixel layer and a driving circuit according to one embodiment of the present invention.

When the projection of the driving circuit 101 over the pixel layer 200 does not overlap with the first sub-pixel 201, as shown in FIG. 17, the driving circuit 101 is disposed directly below a region between the third pixel portion 2011 and the fourth pixel portions 2012. Alternatively, as shown in FIG. 18, the driving circuit 101 is disposed directly below at a side of at least one of the third pixel portion 2011 and the fourth pixel portion 2012. The driving circuit 101 is directly below a side of the fourth pixel portion 2012 is taken as an example here. Similarly, the effective light-transmitting portions of the first sub-pixel 201 are all areas in the corresponding third pixel portion 2011 and the corresponding fourth pixel portion 2012.

Figure 19:
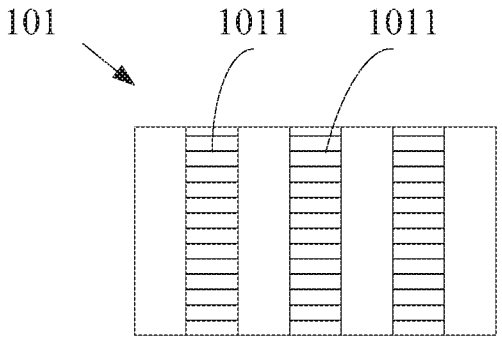
FIG. 19 is a schematic top view of an arrangement of a driving circuit according to one embodiment of the present invention.

In one embodiment, as shown in FIG. 19, the driving circuit 101 comprises a plurality of driving portions 1011. The plurality of driving portions 1011 are arranged in parallel, and a distance between two adjacent driving portions 1011 is the same. The plurality of driving portions 1011 of the same driving circuit 101 may be arranged in parallel in a lateral direction, a longitudinal direction, or some other directions. Herein, the plurality of driving portions 1011 of the same driving circuit 101 arranged in parallel in a lateral direction are taken as an example, there are no restrictions on the size of the plurality of driving portions 1011 and the gap between two adjacent driving portions 1011. It can be understood that the driving circuit 101 may be disposed with the plurality of driving sections 1011 according to actual situations, for example, to facilitate the connection of the driving section 1011 with other circuits or to increase the uniformity of light transmission. It is only necessary to satisfy the plurality of the driving portions 1011 being disposed directly below the first region 03.

Figure 20:
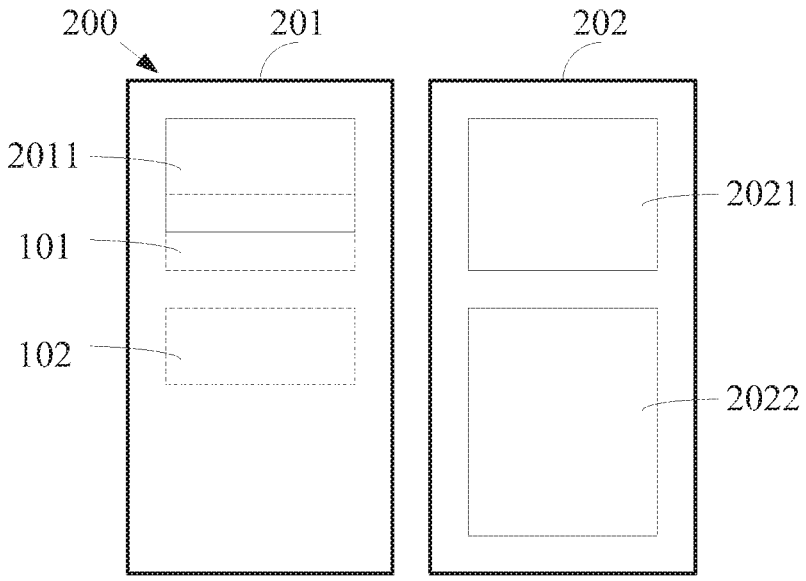
FIG. 20 is a schematic top view of an arrangement of a pixel layer, a driving circuit, and a thin film transistor circuit according to one embodiment of the present invention.

In one embodiment, when the first sub-pixel 201 comprises only the third pixel portion 2011, as shown in FIG. 20, the thin film transistor circuit 102 may also be disposed at any position directly below one side of the third pixel portion 2011. Herein, the thin film transistor circuit 102 is provided directly below the third pixel portion 2011 is taken as an example, and it can be understood that the thin film transistor circuit 102 is used to drive the third pixel portion 2011. The specific structure of the thin film transistor circuit 102 can refer to the gate line 1021 and the circuit structure on the upper side thereof as shown in FIG. 4.

Figure 21:
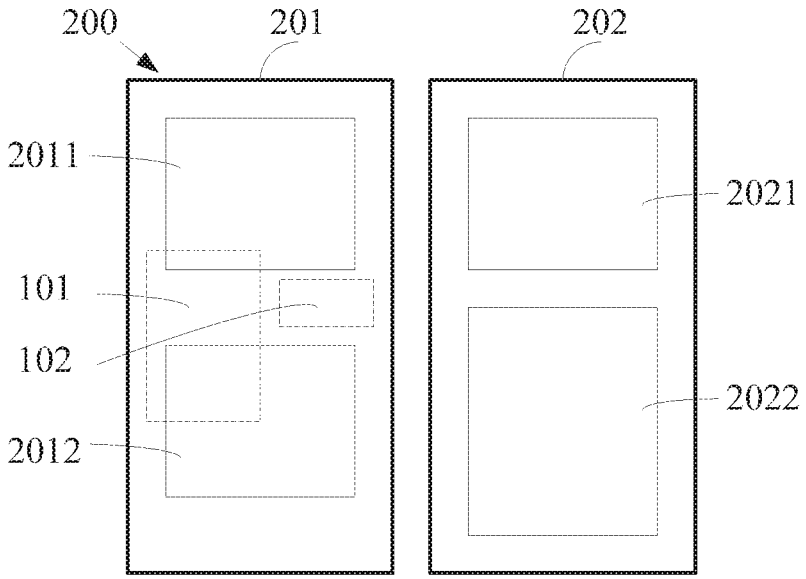
FIG. 21 is a schematic top view of another arrangement of a pixel layer, a driving circuit, and a thin film transistor circuit according to one embodiment of the present invention.

In one embodiment, when the first sub-pixel 201 comprises the third pixel portion 2011 and the fourth pixel portion 2012, as shown in FIG. 21, the thin film transistor circuit 102 may be further disposed directly below an area between the third pixel portion 2011 and the fourth pixel portion 2012. Alternatively, the thin film transistor circuit 102 is disposed directly below either side of one of at least one of the third pixel portion 2011 and the fourth pixel portion 2012. Herein, it is understood that the thin film transistor circuit 102 is located directly below the area between the third pixel portion 2011 and the fourth pixel portion 2012. At this time, the thin film transistor circuit 102 is used to drive the third pixel portion 2011 and the fourth pixel portion 2012. For a specific structure of the thin film transistor circuit 102, reference may be made to the related description of the circuit structure in FIG. 4.

In one embodiment, the driving methods of the first sub-pixel 201 and the second sub-pixel 202 in the present invention comprise, but are not limited to, a 1G1D (1 Gate & 1 Data) driving method, and an HG2D (Half Gate & 2 Data driving method).), a Tri-Gate (Three Gate) drive method, a DLS (Data Line Sharing) drive method.

In one embodiment, the formation process of the first sub-pixel 201 and the second sub-pixel 202 in the present invention may comprise, but is not limited to, MVA (Multi-domain Vertical Alignment), PSA (Patterned Sustained) Alignment, i.e. polymer stable alignment), UV2A (Ultra Violet Vertical Alignment, i.e. ultraviolet vertical alignment).

In one embodiment, the color filter substrate in the present invention may be disposed opposite to the pixel layer or may be disposed in the same layer as the circuit layer.

The invention also provides a display device, which comprises but is not limited to the display panel in the above implementation.

The structures of the display panel and the display device comprising the display panel provided by the embodiments of the present invention have been described in detail above.

In this specification, specific examples are used to explain the principles and implementation of the present invention. The descriptions of the above embodiments are only used to help understand the technical solution of the present invention and its core ideas; those skilled in the art should understand: The technical solutions described in the foregoing embodiments may be modified, or some technical features thereof may be equivalently replaced; and these modifications or replacements do not depart from the scope of the technical solutions of the embodiments of the present invention.

What is claimed is:

1. A display panel, composed of a display area and a non-display area, wherein the display panel comprises a circuit layer, a pixel layer disposed over the circuit layer, and a liquid crystal layer disposed over the pixel layer;

wherein the pixel layer comprises a plurality of first regions and a plurality of second regions, and the first regions are used to form a first sub-pixel, the second regions are used to form a second sub-pixel, and the second sub-pixel comprises a first pixel portion and a second pixel portion, and the first sub-pixel comprises a third pixel portion;

wherein an area of the first pixel portion and an area of the second pixel portion in the second region are different in size, and an area of the third pixel portion in the first region and the area of the first pixel portion or the second pixel portion in the second region are different in size;

wherein the liquid crystal layer comprises a plurality of liquid crystal molecules, wherein an ability of light to pass through the plurality of liquid crystal molecules over the first pixel portion is greater than an ability of light to pass through the plurality of liquid crystal molecules over the second pixel portion, and an ability of light to pass through the plurality of liquid crystal molecules over the third pixel portion is greater than the ability of light to pass through the plurality of liquid crystal molecules over the first pixel portion when the display panel is in operation; and wherein the circuit layer comprises a plurality of driving circuits, and the plurality of driving circuits are disposed in the display area, and the driving circuits are disposed opposite to the first regions, so that difference between a brightness of an image above the first regions and a brightness of an image above the second regions is within a predetermined range.

2. The display panel according to claim 1, wherein the first sub-pixel further comprises a fourth pixel portion, and the third pixel portion and the fourth pixel portion are disposed adjacently.

3. The display panel according to claim 2, wherein a projection of the driving circuits over the pixel layer overlaps or does not overlap with the first sub-pixel.

4. The display panel according to claim 3, wherein the driving circuit is disposed at an arbitrary position directly below the third pixel portion, or a part of the driving circuit is disposed at an arbitrary position directly below the third pixel portion when the projection of the driving circuit over the pixel layer overlaps the first sub-pixel and the first sub-pixel comprises the third pixel portion.

5. The display panel according to claim 3, wherein the driving circuits are disposed at any position directly below at least one of the third pixel portion and the fourth pixel portion, or a portion of the driving circuits are disposed at any position directly below at least one of the third pixel portion and the fourth pixel portion when the projection of the driving circuits over the pixel layer overlaps the first sub-pixel and the first sub-pixel comprises the third pixel portion and the fourth pixel portion.

6. The display panel according to claim 3, wherein the driving circuits are disposed directly below any one side of the third pixel portion when the projection of the driving circuits over the pixel layer does not overlap with the first sub-pixel and the first sub-pixel comprises the third pixel.

7. The display panel according to claim 3, wherein the driving circuits are disposed directly below a region between the third pixel portion and the fourth pixel portion, or the driving circuits are disposed below either side of at least one of the third pixel portion and the fourth pixel portion when the projection of the driving circuits over the pixel layer does not overlap with the first sub-pixel and the first sub-pixel comprises the third pixel portion and the fourth pixel portion.

8. The display panel according to claim 1, wherein the driving circuits comprise a plurality of driving portions, and the plurality of driving portions are arranged in parallel and a distance between two adjacent driving portions is the same.

9. The display panel according to claim 1, wherein the circuit layer further comprises a plurality of thin film transistor circuits, and the thin film transistor circuits are disposed opposite to the first regions and the second regions;

wherein the thin film transistor circuits are disposed directly below a region between the first pixel portion and the second pixel portion;

wherein the thin film transistor circuits are disposed directly below any one side of the third pixel portion when the first sub-pixel comprises the third pixel portion; or wherein the thin film transistor circuits are disposed directly below a region between the third pixel portion and the fourth pixel portion, and the thin film transistor circuits are disposed directly under either side of at least one of the third pixel portion and the fourth pixel portion when the first sub-pixel comprises the third pixel portion and the fourth pixel portion.

10. A display panel, composed of a display area and a non-display area, wherein the display panel comprises a circuit layer, a pixel layer disposed over the circuit layer, and a liquid crystal disposed over the pixel layer;

wherein the pixel layer comprises a plurality of first regions and a plurality of second regions, and the first regions are used to form a first sub-pixel, the second regions are used to form a second sub-pixel, and the second sub-pixel comprises a first pixel portion and a second pixel portion, and the first sub-pixel comprises a third pixel portion;

wherein an area of the first pixel portion and an area of the second pixel portion in the second region are different in size, and an area of the third pixel portion in the first region and the area of the first pixel portion or the second pixel portion in the second region are different in size;

wherein the liquid crystal layer comprises a plurality of liquid crystal molecules, wherein an ability of light to pass through the plurality of liquid crystal molecules over the first pixel portion is greater than an ability of light to pass through the plurality of liquid crystal molecules over the second pixel portion, and an ability of light to pass through the plurality of liquid crystal molecules over the third pixel portion is greater than the ability of light to pass through the plurality of liquid crystal molecules over the first pixel portion when the display panel is in operation;

wherein the circuit layer comprises a plurality of driving circuits, and the plurality of driving circuits are disposed in the display area, and the driving circuits are disposed opposite to the first regions, so that difference between a brightness of an image above the first regions and a brightness of an image above the second regions is within a predetermined range; and wherein a projection of the driving circuit on the pixel layer overlaps or does not overlap with the first sub-pixel.

11. The display panel according to claim 10, wherein the driving circuits are disposed at an arbitrary position directly below the third pixel portion, or a part of the driving circuits are disposed at a position directly below any position of the third pixel portion.

12. The display panel according to claim 10, wherein the driving circuits are disposed directly below any one side of the third pixel portion when the first sub-pixel comprises the third pixel portion.

13. The display panel according to claim 10, wherein the driving circuits comprise a plurality of driving portions, and the plurality of driving portions are arranged in parallel, and a distance between two adjacent driving portions is the same.

14. The display panel according to claim 10, wherein the circuit layer further comprises a plurality of thin film transistor circuits, and the thin film transistor circuits are disposed opposite to the first region and the second regions;

wherein the thin film transistor circuits are disposed directly below a region between the first pixel portion and the second pixel portion;

wherein the thin film transistor circuits are disposed directly below any one side of the third pixel portion when the first sub-pixel comprises the third pixel portion; or wherein the thin film transistor circuits are disposed directly below a region between the third pixel portion and the fourth pixel portion, and the thin film transistor circuits are disposed directly under either side of at least one of the third pixel portion and the fourth pixel portion when the first sub-pixel comprises the third pixel portion and the fourth pixel portion.

15. A display device comprising a display panel, the display panel composed of a display area and a non-display area, wherein the display panel comprises a circuit layer and a pixel layer provided over the circuit layer and a liquid crystal layer disposed over the pixel layer;

wherein the pixel layer comprises a plurality of first regions and a plurality of second regions, and the first regions are used to form a first sub-pixel, the second regions are used to form a second sub-pixel, and the second sub-pixel comprises a first pixel portion and a second pixel portion, and the first sub-pixel comprises a third pixel portion;

wherein an area of the first pixel portion and an area of the second pixel portion in the second region are different in size, and an area of the third pixel portion in the first region and the area of the first pixel portion or the second pixel portion in the second region are different in size;

wherein the liquid crystal layer comprises a plurality of liquid crystal molecules, wherein an ability of light to pass through the plurality of liquid crystal molecules over the first pixel portion is greater than an ability of light to pass through the plurality of liquid crystal molecules over the second pixel portion, and an ability of light to pass through the plurality of liquid crystal molecules over the third pixel portion is greater than the ability of light passes through the plurality of liquid crystal molecules over the first pixel portion when the display panel is operating; and wherein the circuit layer comprises a plurality of driving circuits, and the plurality of driving circuits are disposed in the display area, and the driving circuits are disposed opposite to the first regions, so that difference between a brightness of an image above the first regions and a brightness of an image above the second regions is within a predetermined range.

16. The display device according to claim 15, wherein the first sub-pixel further comprises a fourth pixel portion, and the third pixel portion and the fourth pixel portion are disposed adjacently.

17. The display device according to claim 16, wherein the projection of the driving circuit over the pixel layer overlaps or does not overlap the first sub-pixel.

18. The display device according to claim 17, wherein the driving circuits are disposed at an arbitrary position directly below the third pixel portion, or a part of the driving circuit is disposed at an arbitrary position directly below the third pixel portion when the projection of the driving circuits over the pixel layer overlaps the first sub-pixel and the first sub-pixel comprises the third pixel portion.

19. The display device according to claim 17, wherein the driving circuits are disposed at any position directly below at least one of the third pixel portion and the fourth pixel portion, or a portion of the driving circuits is disposed at any position directly below at least one of the third pixel portion and the fourth pixel portion when the projection of the driving circuit over the pixel layer overlaps the first sub-pixel and the first sub-pixel comprises the third pixel portion and the fourth pixel portion.

20. The display device according to claim 15, wherein the driving circuits are disposed directly below a region between the third pixel portion and the fourth pixel portion, or the driving circuits are disposed below either side of at least one of the third pixel portion and the fourth pixel portion when the projection of the driving circuit over the pixel layer does not overlap with the first sub-pixel and the first sub-pixel comprises the third pixel and the fourth pixel portion.

* * * * *